US012655644B1

(12) United States Patent
Cupp

(10) Patent No.: US 12,655,644 B1
(45) Date of Patent: Jun. 16, 2026

(54) TILE BUTTERER

(71) Applicant: Jason L Cupp, Fort Walton Beach, FL (US)

(72) Inventor: Jason L Cupp, Fort Walton Beach, FL (US)

( * ) Notice: Subject to any disclaimer, the term of this patent is extended or adjusted under 35 U.S.C. 154(b) by 337 days.

(21) Appl. No.: 18/586,431

(22) Filed: Feb. 24, 2024

(51) Int. Cl.
*E04F 21/08* (2006.01)

(52) U.S. Cl.
CPC ..... *E04F 21/08* (2013.01)

(58) Field of Classification Search
USPC ..... 52/749.11; 15/143.1, 235.4, 235.6, 15/245.1; 222/611.2
See application file for complete search history.

(56) References Cited

U.S. PATENT DOCUMENTS 1,993,656 A * 3/1935 Gardiner ..... E01C 19/484 404/106
2,497,578 A * 2/1950 Bradley, Jr. ..... G01N 33/32 15/245.1
2,630,703 A * 3/1953 Sommers ..... E04F 21/08 425/87
3,119,138 A * 1/1964 Davis ..... E01C 19/16 15/207.2
3,451,757 A * 6/1969 Vaughan ..... E04D 15/07 401/5
3,791,559 A * 2/1974 Foye ..... E04G 21/204 222/240
4,804,321 A * 2/1989 Riesgo ..... E04F 21/241 401/5
4,830,594 A * 5/1989 Dawson ..... E04F 21/08 401/5
4,889,330 A * 12/1989 McSwain ..... B25B 5/10 269/95
5,203,641 A * 4/1993 Kranich ..... E04F 21/162 404/93
5,807,022 A * 9/1998 McCleary ..... E04F 21/241 52/749.11
5,937,628 A * 8/1999 Matechuk ..... E04F 21/244 56/400.05
6,308,370 B1 * 10/2001 Southby ..... E04F 21/20 15/236.08
10,232,403 B1 * 3/2019 Daranuta ..... E04F 21/163
2003/0056313 A1 * 3/2003 Sakurai ..... H01J 9/242 15/236.08

(Continued)

*Primary Examiner* — Brian E Glessner
*Assistant Examiner* — Adam G Barlow
(74) *Attorney, Agent, or Firm* — Peter Loffler

(57) ABSTRACT

A tile buttering system has a hopper that has a base member with a fixed wall on one side and a generally parallel movable wall on the opposing side. A back wall is located at one end of the base member so that a fixed gap exists between the back wall and the base member. A front wall, which is a trowel blade is located at the second opposing end of the hopper. The height between the base member and the front wall is variable as is the distance between the fixed wall and the movable wall. Appropriate set screws lock the trowel at its desired height and the movable wall at its desired distance from the fixed wall. The hopper is filled with an adhesive, tile is passed into the hopper via the gap at the back wall, and the tile exits the hopper via the gap at the trowel blade. The tile exits the hopper buttered with the adhesive to a desired thickness and troweled.

16 Claims, 5 Drawing Sheets

(56) References Cited

U.S. PATENT DOCUMENTS

| | | | | |
|---|---|---|---|---|
| 2010/0212256 | A1* | 8/2010 | Llorens Selles | E04F 21/163<br>52/749.11 |
| 2014/0057059 | A1* | 2/2014 | Daubert | E04F 21/08<br>401/137 |
| 2016/0177580 | A1* | 6/2016 | Milane | E04F 21/162<br>401/48 |
| 2026/0048411 | A1* | 2/2026 | Lau | B05B 15/62 |

* cited by examiner

TILE BUTTERER

BACKGROUND OF THE INVENTION

1. Field of the Invention

The present invention relates to a device that butters the wall facing surface of tiles with a desired tile adhesive such as mortar, mastic, or thin set, such that the depth of the adhesive is uniform between tiles that have been buttered by the device.

2. Background of the Prior Art

Laying tile on a floor or other horizontal surface is relatively straightforward. Cover the floor area (or a portion at a time) with an appropriate adhesive (mastic, mortar, thin set, etc.), assuring that there is substantial coverage, lay the tile with appropriate spacing, using spacers as needed, and assure that the upper tile surface is level. Thereafter, allow the adhesive to properly cure, add desired grout, and the job is finished. To a skilled tile layer, this process is the backbone of the tiling day and is relatively easy. Even if the tile layer makes a mistake, such as having incomplete adhesive coverage underneath a portion of a tile, the mistake tends to be of little moment as the tile, being on a horizontal surface, will not move as it is held in place by the adhesive that is in contact with the tile and the surface upon which the tile is laid as well as adjoining tiles that are buffered thereto by the grout, if used.

The problem arises when laying tile on a vertical surface such as in a shower enclosure or a kitchen backsplash. In such applications, the tile, being vertically laid, must resist the force of gravity that is trying to pull the tile off the surface upon which the tile is installed. In such applications, attention to adhesive selection as well as application is paramount. If insufficient adhesive is present to bond the tile to its application surface, the tile can fall off via the force of gravity, especially when using relatively large, heavy tile.

To address the problems associated with vertically laid tiles, many tile artisans do not cover the attachment surface with the adhesive, preferring to butter the tile. Buttering the tile involves placing the adhesive directly onto the backside attachment surface of the tile and then the attaching the buttered tile into position. By buttering the tile, the adhesive is keyed into the tile thereby increasing the bond strength of the adhesive with the tile. Additionally, the adhesive fills the voids on the back surface of the tile while creating a flat attachment surface for the tile. Buttering the tile also fills the inherent warpage that is found on many tiles, particularly larger tiles.

While buttering the tile optimizes the adhesive attachment outcome for the laid tile, there is a drawback. When the attachment surface is mudded in conventional fashion, constant thickness is achieved by the tile layer during the adhesive spreading process A constant thickness of adhesive between attachment surface and the tiles is needed for a smooth flat finish. However, during tile buttering process, in order to achieve this smooth flat finish, the layer must assure that each tile is buttered to the same thickness lest some tiles sit higher above the attachment surface than others. This is accomplished by inspecting each tile after being buttered to assure that the adhesive thickness is the same as previously buttered tiles. Not only is this process difficult, requiring a keen touch and a skilled set of eyes, it is also time consuming as the tile layer must inspect each tile after being buttered, possibly making adjustments and reinspections thereafter. Even with the best trained eyes, mistakes happen and a tile may need to be removed after being laid in order to be rebuttered, further slowing the overall job down.

To address this issue, tile buttering systems have been proposed that take the "guess work" out of the buttering process by buttering each tile to a constant thickness of adhesive. While such systems are effective, they are unusually complex in design and operation and are expensive.

What is needed is a device that allows a tile professional to be able to butter a series of tiles so that each tile has the same thickness of adhesive thereon. Such a device must be simple in design and be easy to operate.

SUMMARY OF THE INVENTION

The tile butterer of the present invention addresses the aforementioned needs in the art by providing a system that butters each tile passing through the system with an adhesive that has a constant thickness for each tile so buttered. The tile butterer is of relatively simple design and construction, being produced using standard manufacturing techniques, making the device relatively inexpensive to produce thereby making the device economically attractive to potential consumers for this type of device. Set up and operation of the tile butterer is quick and straightforward.

The tile butterer of the present invention is comprised of a base member that has a first end and an opposing second end joined by a first side and an opposing second side, A fixed wall extends upwardly from the base member proximate the first side of the base member. A back wall extends upwardly from base member and is attached to the fixed wall such that a first gap exists between the base member and the back wall. A movable wall extends upwardly from the base and is connected to the back wall and is substantially parallel with the fixed wall. The distance between the movable wall and the fixed wall is variable. A front wall, which is a trowel blade, is removably attached to the fixed wall and to the movable wall, such that a second gap exists between the base member and the front wall. The second gap formed by the base member and the front wall is variable in height. The movable wall is held in a given position by at least one set screw that is attached to the movable wall and that presses into the base member when tightened. The front wall is held in a given position by a first set screw that is attached to the fixed wall with this set screw pressing the front wall into the fixed wall and/or a second set screw that is attached to the movable wall with this set screw pressing the front wall into the movable wall. The movable wall has a first pin that is received within a first channel located on the base member and a second pin that is received within a second channel located on the back wall. When the base member is in a horizontal position, the front wall is positioned non-perpendicular with respect to the base member with the top edge of the front wall closer to the back wall relative to the bottom edge of the front wall.

BRIEF DESCRIPTION OF THE DRAWINGS

Similar reference numerals refer to similar parts throughout the several views of the drawings.

DESCRIPTION OF THE PREFERRED EMBODIMENT

Figure 1:
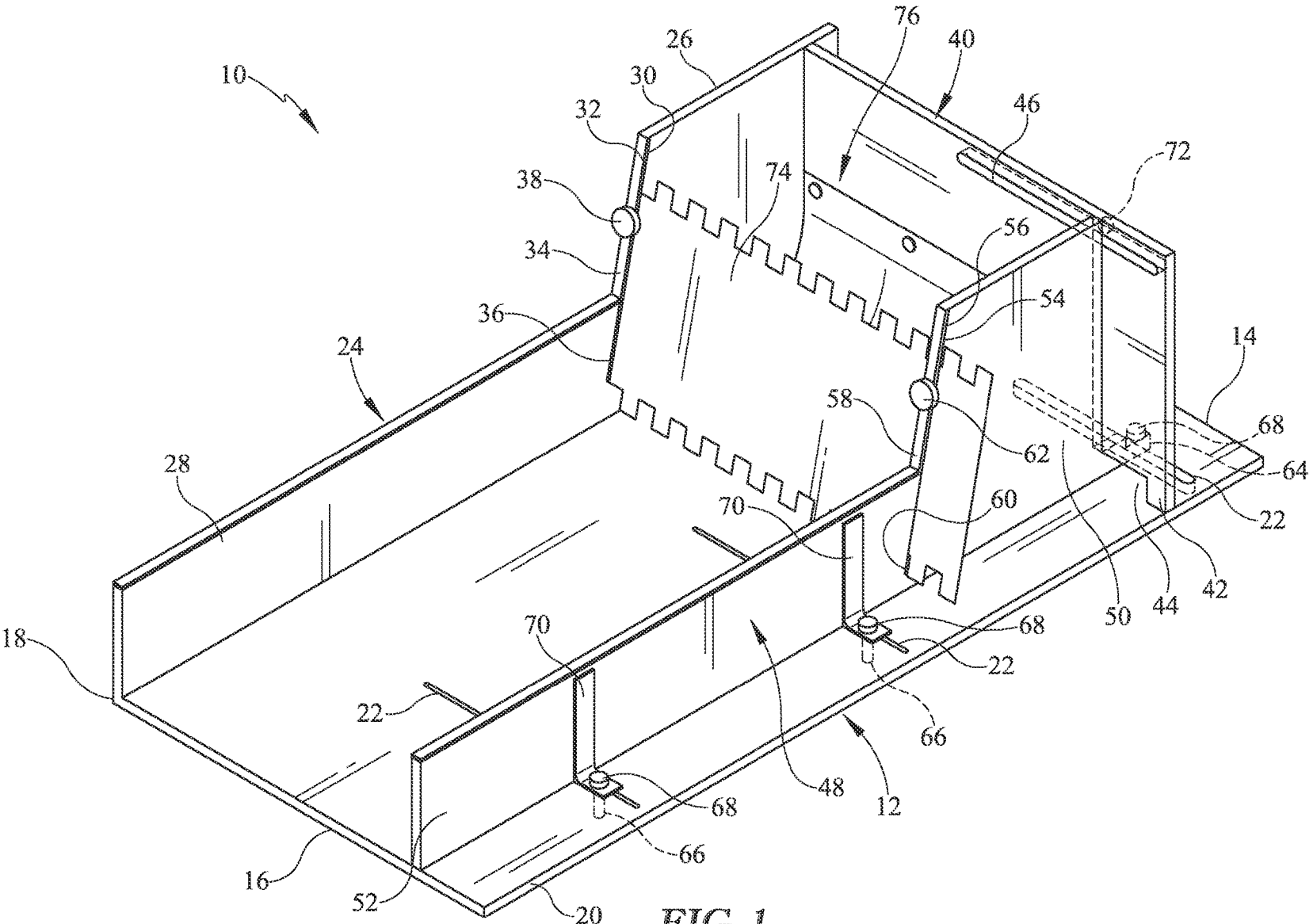
FIG. 1 is a perspective view of the tile butterer of the present invention.
Figure 2:
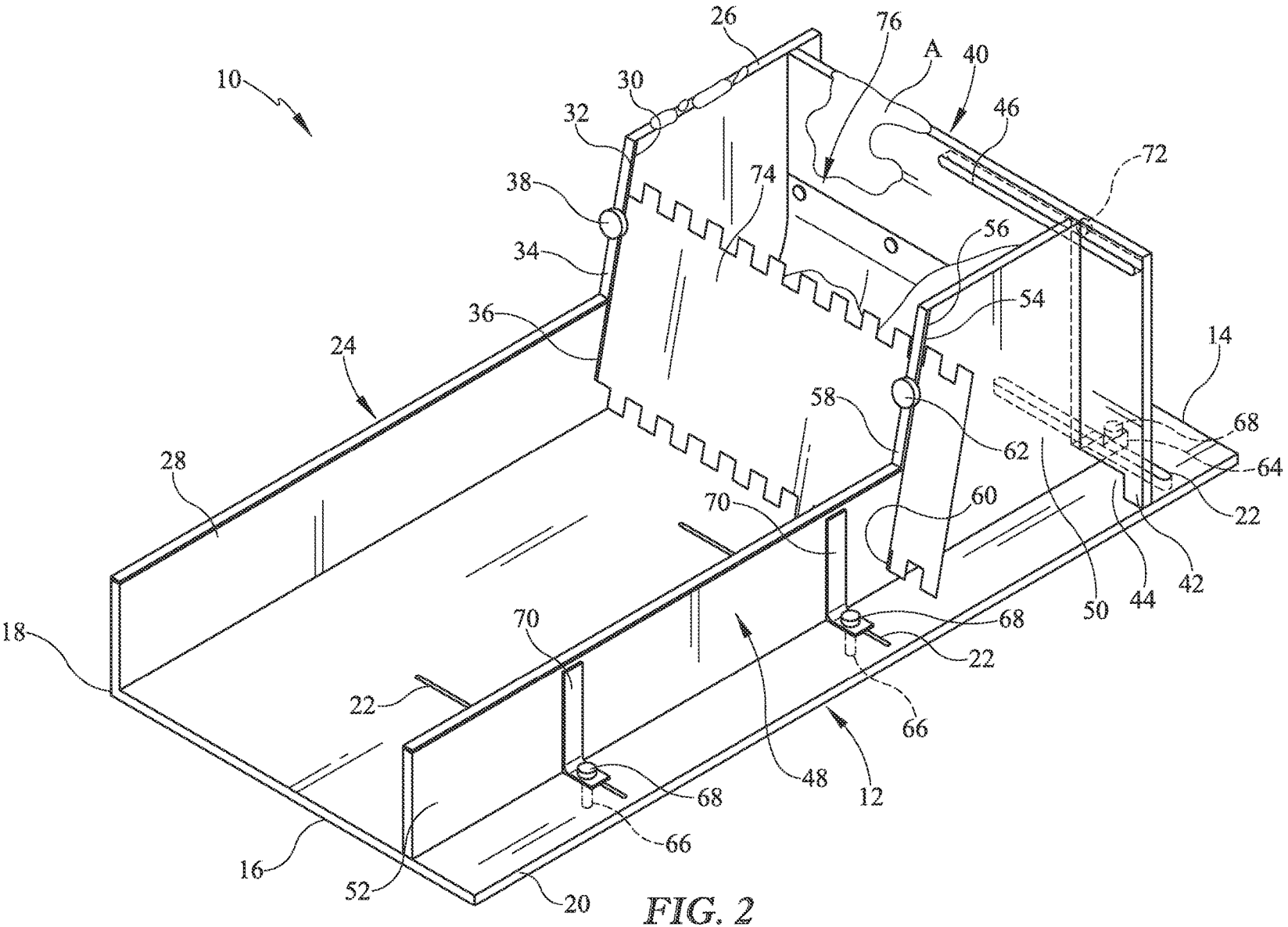
FIG. 2 is a perspective view of the tile butterer with adhesive held within the hopper.
Figure 3:
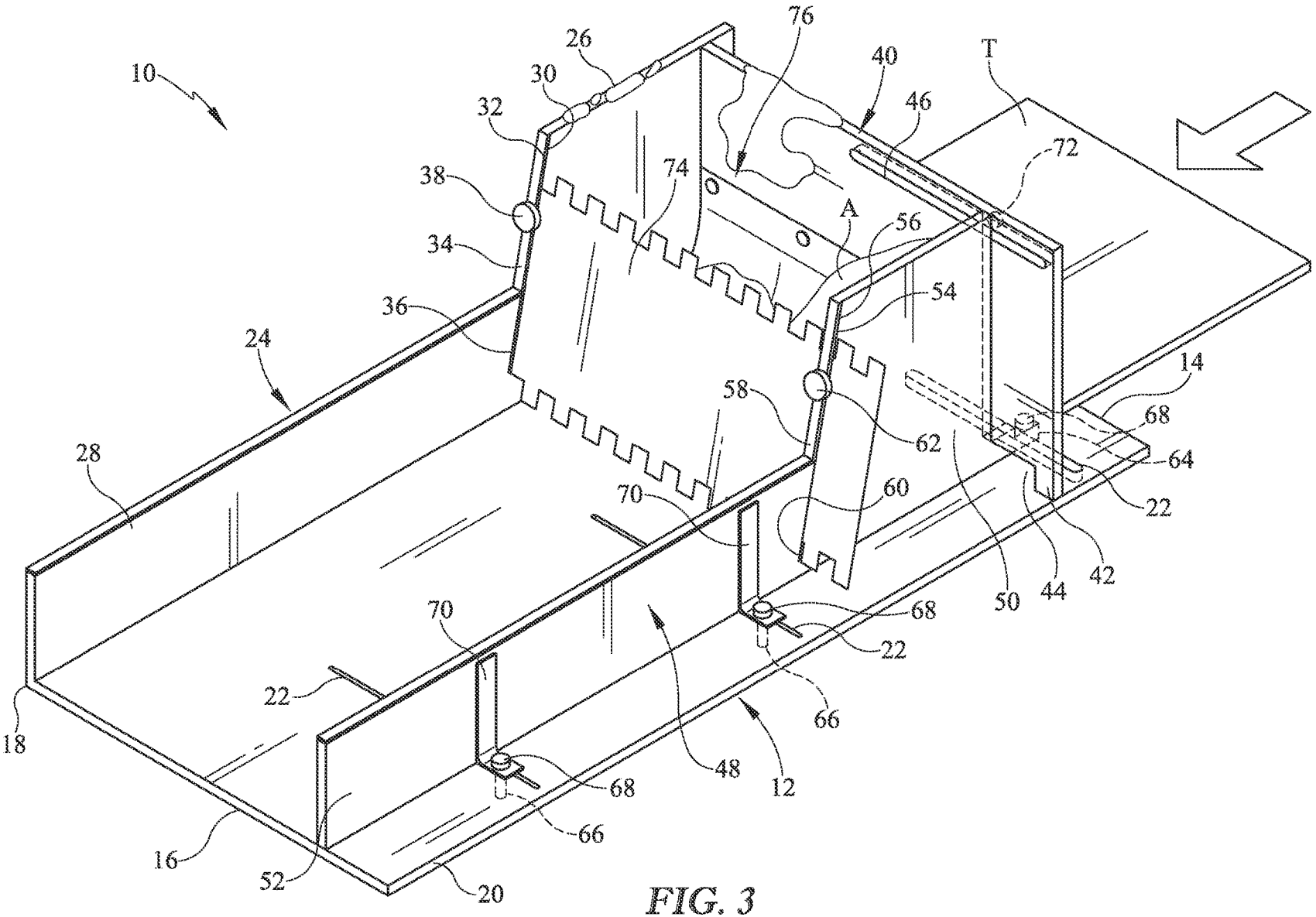
FIG. 3 is a perspective view of the tile butterer with a tile about to be buttered by the device.
Figure 4:
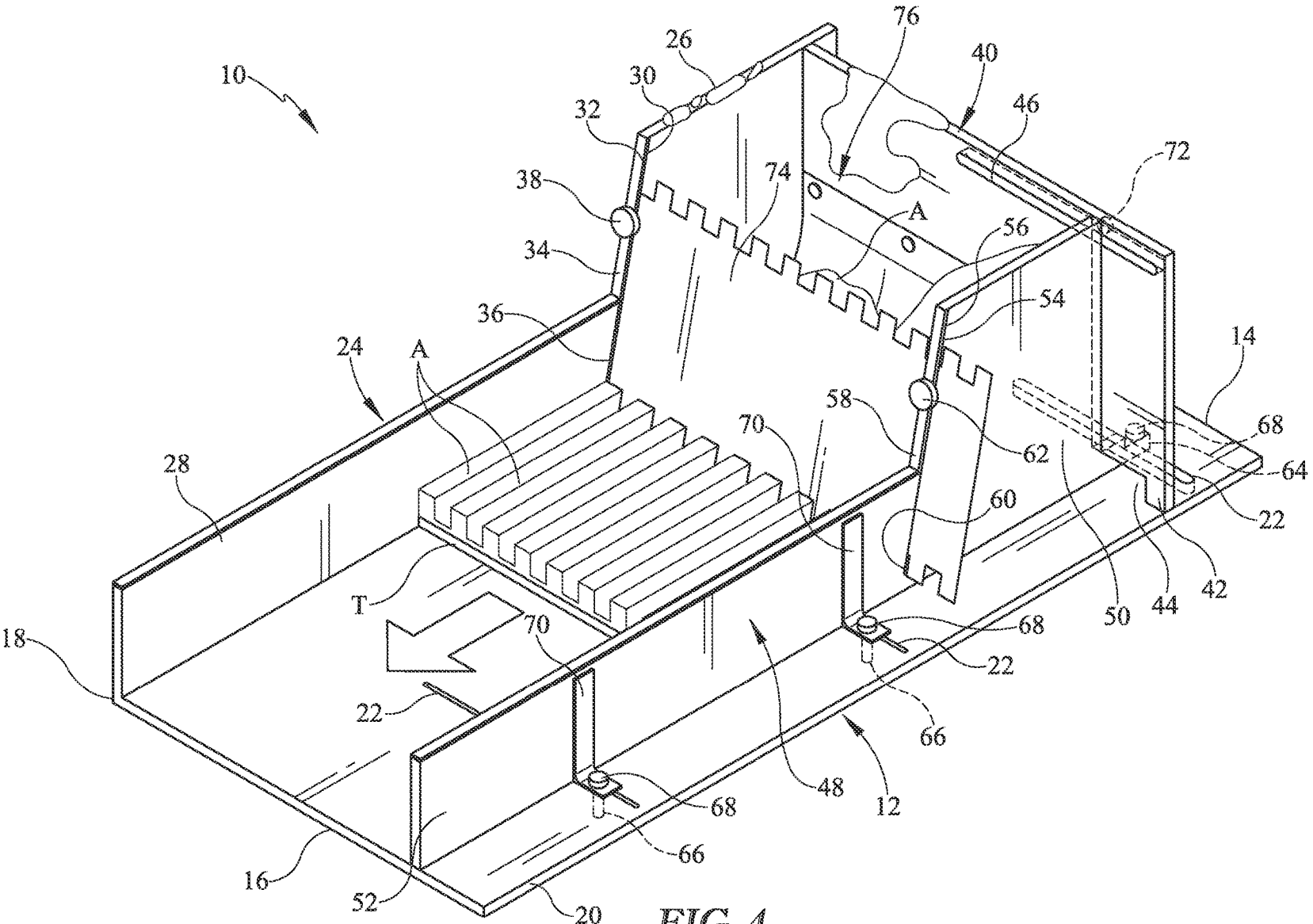
FIG. 4 is a perspective view of the tile butterer with a tile being the buttered by the device.
Figure 5:
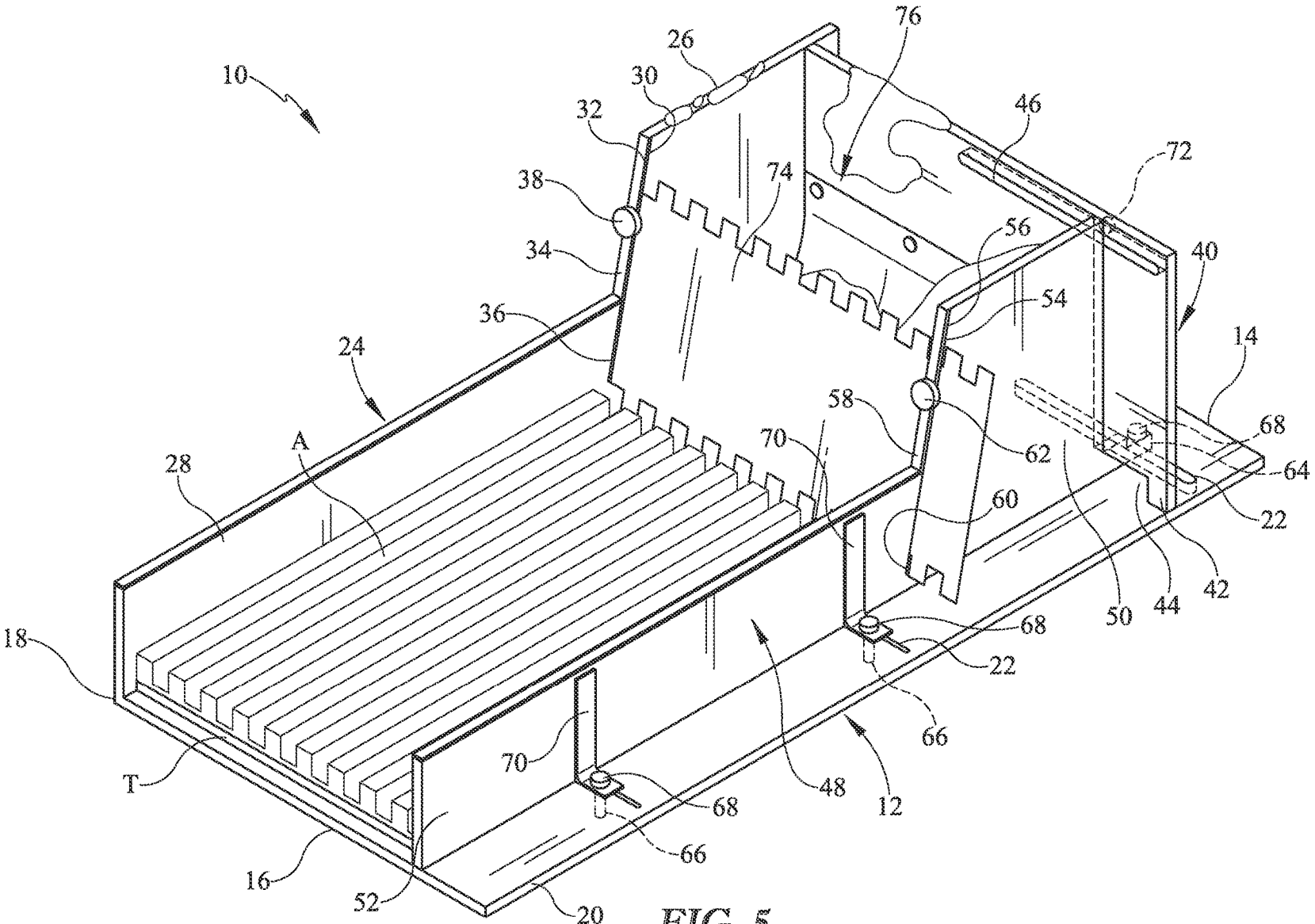
FIG. 5 is a perspective view of the tile butterer with a tile after being buttered by the device.

Referring now to the drawings, it is seen that the tile butterer of the present invention, generally denoted by reference numeral 10, is comprised of a base member 12 that is a relatively flat sheet member. The base member 12 has a first end 14 and an opposing second end 16 joined by a first side 18 and an opposing second side 20. Two or more elongated and parallel base channels 22 are located on the base member 12.

A fixed wall 24 extends upwardly from the base member 12 at the first side 18 thereof. As seen, the fixed wall 24 has a first high wall portion 26, a first low wall portion 28 and a first transitional edge 30 that has a first slit 32 thereat. The first slit 32 is formed by a first strip member 34 that is attached to the upper edge of the first high wall portion 26 and to the first low wall portion 28 and not attached to the first transitional edge 30 as well as by a first sub-slit 36 formed in the fixed wall 24. A first set screw 38 is attached to the first strip member 34 along the first slit 32. The fixed wall 24 can be formed as an integral part of the base member 12 or can be attached thereto in appropriate fashion.

A back wall 40 extends upwardly from the base member 12 just offset from the first end 14 of the base member 12 and is attached to the fixed wall 14 in appropriate fashion. The back wall 40 sits on the base member 12 via a pair of legs 42 (only one illustrated) located on the back wall's outer edges so that a gap 44 exists between the base member 12 and the back wall 40 between the legs 42—the legs 42 may be fixedly attached to the base member 12. A wall channel 46 is located on the back wall 40.

A movable wall 48 extends upwardly from the base member 12. The movable wall 48 is somewhat similar in size and shape to the fixed wall 24 and is parallel with the fixed wall 24. As seen, the movable wall 48 has a second high wall portion 50, a second low wall portion 52 and a second transitional edge 54 that has a second slit 56 thereat. The second slit 56 is formed by a second strip member 58 that is attached to the upper edge of the second high wall portion 50 and to the second low wall portion 52 and not attached to the second transitional edge 54 as well as by a first sub-slit 60 formed in the movable wall 48. A second set screw 62 is attached to the second strip member 58 along the second slit 56. The movable wall 48 also has a tail 64 that extends outwardly from the lower portion of the second high wall portion 50 so that the tail 64 passes underneath the gap 44 formed by the base member 12 and the back wall 40. A set of base pins 66 extend downwardly from the lower edge of the second low wall portion 52 and from the tail 64 such that these base pins 66 are each received within a respective one of the base channels 22 on the base member 12. Each base pin 66 has a base set screw 68 associated therewith with the base set screws 68 extending from the second low wall portion 52 and attached to the second low wall portion 52 via a bracket 70 while the base set screw 68 associated with the tail 64 is attached directly to the tail 64. A wall pin 72 extends outwardly from the second high wall portion 50 of the movable wall 48 and is received within the wall channel 46 of the back wall 40.

The movable wall 48 moves toward and away from the fixed wall 24. The base pins 66 received within their respective base channels 22 and the wall pin 72 received within the wall channel 46 help keep the movable wall 48 steady during movement. When the movable wall 48 is in a desired position, the base set screws 68 are tightened against the base member 12 in appropriate fashion in order to hold the moveable wall 48 firm. While wall pin and base channel subsystems can also be associated with the second high wall portion 50 of the movable wall 48, the fact that an adhesive will be present in this area would cause subsystem clogging so that such subsystems are not present here.

In order to use the tile butterer 10 of the present invention, the movable wall 48 is slid into a position that is a desired distance between itself and the fixed wall 24, the desired distance being the approximate width of the tiles T to be buttered. Once the movable wall 48 is at the desired distance from the fixed wall 24, the base set screws 68 are tightened to hold the movable wall 48 in this position. A trowel blade 74 of a desired pattern is selected and is slid into the first slit 32 and into the second slit 56. The trowel blade 74 is positioned at a desired height from the base member 12 in order to achieve a desired depth of adhesive A deposited onto a tile T. Once the trowel blade 74 is at the desired height, the first set screw 38 and the second set screw 62 are each tightened in appropriate fashion to hold the trowel blade 74 in this position. A hopper 76 is formed by the first high wall portion 26 of the fixed wall 24, the back wall 40, the second high wall portion 50 of the movable wall 48, and the trowel blade 74 with the entrance to the hopper 76 so formed being the gap 44 between the base member 12 and the exit from the hopper 76 being the gap between the base member 12 and the trowel blade 74.

With the hopper 76 properly sized, the hopper 76 is filled with a desired adhesive A. A tile T is slid into the hopper 76 via the entrance at the gap 44 between the base member 12 and the back wall 40. Tas the tile T is slid through the hopper, the adhesive A is piled onto the tile T. As the tile T is exiting the hopper 76 through the gap between the base member 12 and the trowel blade 74, the trowel blade 74 skims excess adhesive from the tile T, keeping this excess adhesive within the hopper 76, while imprinting the desired trowel pattern onto the adhesive A. Once the tile T exits the hopper 76, the tile T sits on the area formed by the base member 12, the first low wall portion 28 of the fixed wall 24 and the second low wall portion 52 of the movable wall 48 from where a worker retrieves the buttered tile T and installs the tile T accordingly. If the tiles T are passed through the hopper 76 in abutting relationship, that is that as one tile T is in the hopper 76 being buttered, the next tile T to be buttered abuts the first tile T, seepage of adhesive A from the hopper 76 out through the gap 44 formed between the base member 12 and the back wall 40 is minimized.

Having the first slit 32 and the second slit 56, and thus the trowel blade 74, offset from vertical (the top edge of the trowel 74 is closer to the vertically positioned back wall 40 relative to the bottom edge of the trowel 74), helps reduce flutter of the trowel blade 74 during device usage, which fluttering can reduce the quality of the buttering process.

The various components of the tile butterer 10 can be made from appropriate materials such as metal, hard plastic, etc., or a combination thereof.

While the invention has been particularly shown and described with reference to an embodiment thereof, it will be appreciated by those skilled in the art that various changes in form and detail may be made without departing from the spirit and scope of the invention.

I claim:

1. A hopper:

a base member having a first end and an opposing second end joined by a first side and an opposing second side;

a fixed wall extending upwardly from the base member proximate the first side of the base member;

a back wall extending upwardly from base member and attached to the fixed wall such that a first gap exists between the base member and the back wall;

a movable wall extending upwardly from the base and connected to the back wall, the distance between the movable wall and the fixed wall being variable; and a front wall removably attached to the fixed wall and to the movable wall, such that a second gap exists between the base member and the front wall, the second gap being variable in height between the base member and the front wall.

2. The hopper was in claim 1 wherein the front wall is a trowel blade.

3. The hopper as in claim 1 wherein the movable wall is held in a given position by a set screw attached to the movable wall, the set screw pressing into the base member.

4. The hopper as in claim 1 wherein the front wall is held in a given position by a set screw attached to the fixed wall, the set screw pressing the front wall into the fixed wall.

5. The hopper as in claim 1 wherein the front wall is held in a given position by a set screw attached to the movable wall, the set screw pressing the front wall into the movable wall.

6. The hopper as in claim 1 wherein the front wall is held in a given position by a first set screw attached to the fixed wall, the first set screw pressing the front wall into the fixed wall and a second set screw attached to the movable wall, the second set screw pressing the front wall into the movable wall.

7. The hopper as in claim 1 wherein the movable wall has a first pin that is received within a first channel located on the base member.

8. The hopper as in claim 7 wherein the movable wall has a second pin that is received within a second channel located on the back wall.

9. A hopper:

a base member having a first end and an opposing second end joined by a first side and an opposing second side;

a fixed wall extending upwardly from the base member proximate the first side of the base member;

a back wall extending upwardly from base member and attached to the fixed wall such that a first gap exists between the base member and the back wall;

a movable wall extending upwardly from the base and connected to the back wall, the distance between the movable wall and the fixed wall being variable; and a front wall, which is a trowel blade, the front wall having a top edge facing upwardly and an opposing bottom edge facing downwardly toward the base member, the front wall removably attached to the fixed wall and to the movable wall, such that a second gap exists between the base member and the front wall, the second gap being variable in height between the base member and the front wall and wherein the base member is located on a first plane and the front wall is located on a second plane such that the first plane and the second plane are non-perpendicular to one another.

10. The hopper as in claim 9 wherein the movable wall is held in a given position by a set screw attached to the movable wall, the set screw pressing into the base member.

11. The hopper as in claim 9 wherein the front wall is held in a given position by a set screw attached to the fixed wall, the set screw pressing the front wall into the fixed wall.

12. The hopper as in claim 9 wherein the front wall is held in a given position by a set screw attached to the movable wall, the set screw pressing the front wall into the movable wall.

13. The hopper as in claim 9 wherein the front wall is held in a given position by a first set screw attached to the fixed wall, the first set screw pressing the front wall into the fixed wall and a second set screw attached to the movable wall, the second set screw pressing the front wall into the movable wall.

14. The hopper as in claim 9 wherein the movable wall has a first pin that is received within a first channel located on the base member.

15. The hopper as in claim 14 wherein the movable wall has a second pin that is received within a second channel located on the back wall.

16. The hopper as in claim 9 wherein the top edge of the front wall is closer to the back wall relative to the bottom edge of the front wall.

* * * * *